United States Patent [19]

Flanagan

[11] 4,034,724

[45] July 12, 1977

[54] STRATIFIED CHARGING OF INTERNAL COMBUSTION ENGINES

[76] Inventor: Richard P. Flanagan, 11460 SW. 83 Terrace, Miami, Fla. 33173

[21] Appl. No.: 676,862

[22] Filed: Apr. 14, 1976

[51] Int. Cl.[2] ..... F02B 19/10

[52] U.S. Cl. ..... 123/75 B; 123/8.13; 123/32 SP; 123/59 B; 123/65 R; 123/DIG. 10; 261/DIG. 69

[58] Field of Search ..... 123/8.13, 32 SP, 32 ST, 123/59 R, 59 A, 59 B, 59 BM, 59 EC, 65 R, 75 B, 119 R, DIG. 10; 261/DIG. 69; 137/804, 819

[56] References Cited

U.S. PATENT DOCUMENTS

| | | | |
|---|---|---|---|
| 1,730,117 | 10/1929 | Brownrigg | 123/59 B |
| 2,240,088 | 4/1941 | Birkigt | 123/75 B |
| 2,940,432 | 6/1960 | Hijszeler | 123/75 B |
| 3,289,656 | 12/1966 | Strand | 123/59 B |
| 3,302,935 | 2/1967 | York, Jr. | 261/DIG. 69 |
| 3,581,719 | 6/1971 | Gau | 123/119 R |
| 3,690,625 | 9/1972 | Ishida | 261/DIG. 69 |
| 3,741,181 | 6/1973 | Martin | 261/DIG. 69 |
| 3,800,763 | 4/1974 | Pouit | 123/59 BM |

*Primary Examiner*—Carroll B. Dority, Jr.
*Assistant Examiner*—David D. Reynolds
*Attorney, Agent, or Firm*—Samuelson & Jacob

[57] ABSTRACT

Method and apparatus for providing a stratified charge of air and a fuel-rich, fuel-air mixture to each combustion chamber of an internal combustion engine having more than one combustion section by providing alternate sources of intake air at the intake of each combustion chamber, establishing a fuel-rich, fuel-air mixture in one alternate source and switching between the alternate sources during induction of a charge of fuel and air in one of the combustion sections in response to a cyclic pressure change in another combustion section such that the charge passing into each combustion chamber will be stratified into portions of air and a fuel-rich, fuel-air mixture.

21 Claims, 14 Drawing Figures

| COMBUSTION SECTION | | | |
|---|---|---|---|
| 622 | 624 | 626 | 628 |
| INTAKE | EXHAUST | FIRING | COMPRESSION |
| COMPRESSION | INTAKE | EXHAUST | FIRING |
| FIRING | COMPRESSION | INTAKE | EXHAUST |
| EXHAUST | FIRING | COMPRESSION | INTAKE |

STRATIFIED CHARGING OF INTERNAL COMBUSTION ENGINES

The present invention relates generally to internal combustion engines and pertains, more specifically, to method and apparatus for providing a stratified charge of air and a fuel-rich, fuel-air mixture to the combustion chambers of such engines.

In recent years, internal combustion engines have come under closer scrutiny as sources of air pollution. Many approaches have been suggested and tried in efforts to reduce pollutants produced during the combustion process in such engines. One such approach is the employment of a stratified charge of fuel and air in the combustion chambers of the engines.

It has been found that the emission of pollutants can be controlled through the use of a stratified charge consisting of a portion or zone of pure air and a zone of fuel-rich, fuel-air mixture, placed in the combustion chamber in such a way that ignition occurs first in the fuel-rich zone of the stratified charge. By choosing the fuel-air ratio in the fuel-rich zone so that the ratio is above the stoichiometric ratio, combustion temperature is lowered to reduce nitrous oxides. As the combustion process extends into the zone of pure air, hydrocarbons and carbon monoxides are oxidized to reduce these pollutants to a minimum.

It is an object of the present invention to provide method and apparatus by which a stratified charge is established in the combustion chamber of an internal combustion engine to reduce to a minimum the emission of pollutants from the engine.

Another object of the invention is to provide method and apparatus by which a stratified charge is established in the combustion chamber of an internal combustion engine by placing a monostable fluidic amplifier into the air induction system of the engine, introducing fuel into one output leg of the fluidic amplifier and controlling the air flow in the amplifier by using a bleed from a location in the engine where a change in pressure occurs cyclically in relation to the rotating output shaft of the engine.

Still another object of the invention is to provide method and apparatus by which a stratified charge is established in the combustion chamber of a variety of types of internal combustion engines, such as, for example, two-cycle reciprocating engines, four-cycle reciprocating engines and rotary engines.

A further object of the invention is to provide method and apparatus of the type described and which is effective in increasing the efficiency of operation of an internal combustion engine, and especially in increasing fuel economy in a two-cycle reciprocating engine, while being responsive to the demands of high speed operation in such engines.

A still further object of the invention is to provide method and apparatus for establishing a stratified charge in an internal combustion engine, the apparatus being simple in design and construction.

Another object of the invention is to provide method and apparatus for establishing a stratified charge in an internal combustion engine, the method and apparatus being adaptable readily to current engine designs with minimal changes in the basic arrangements of operating components of the engines.

The above objects, as well as still further objects and advantages, are attained by the invention which may be described briefly as providing, in an internal combustion engine having at least first and second combustion sections, each combustion section including an induction arrangement, an exhaust arrangement and a combustion chamber, a system for providing a stratified charge of air and a fuel-rich fuel-air mixture to each combustion chamber, the system comprising an intake for each combustion chamber, induction means associated with each intake, each induction means providing alternate sources of air at the intake, the alternate sources including a first intake air passage and a second intake air passage, each communicating with the intake, means for supplying fuel to establish a fuel-rich fuel-air mixture in one of the first and second intake air passages of each induction means, and fluidic means for switching the source of intake air from the first intake air passage to the second intake air passage during induction of a charge of fuel and air in one of the combustion sections in response to a cyclic pressure change in the other combustion section such that the charge passing into the intake will be stratified into portions of air and a fuel-rich fuel-air mixture.

The invention further contemplates a method of providing a stratified charge of air and a fuel-rich fuel-air mixture to each combustion chamber of an internal combustion engine having at least first and second combustion sections, each combustion section including a combustion chamber having an intake and an exhaust, an induction arrangement communicating with the intake and an exhaust arrangement communicating with the exhaust, the method comprising the steps of providing alternate sources of air at the intake of each combustion chamber, the alternate sources including a first source of intake air and a second source of intake air, supplying fuel to establish a fuel-rich, fuel-air mixture in one of the sources of intake air for each intake, switching the source of intake air from the first intake air source to the second intake air source during induction of a charge of fuel and air in one of the combustion sections in response to a cyclic pressure change in the other combustion section such that the charge passing into the intake will be stratified into portions of air and a fuel-rich, fuel-air mixture.

The invention will be more fully understood, while still further objects and advantages will become apparent, by reference to the following detailed description of preferred embodiments illustrated in the accompanying drawing, in which.

Figure 12:
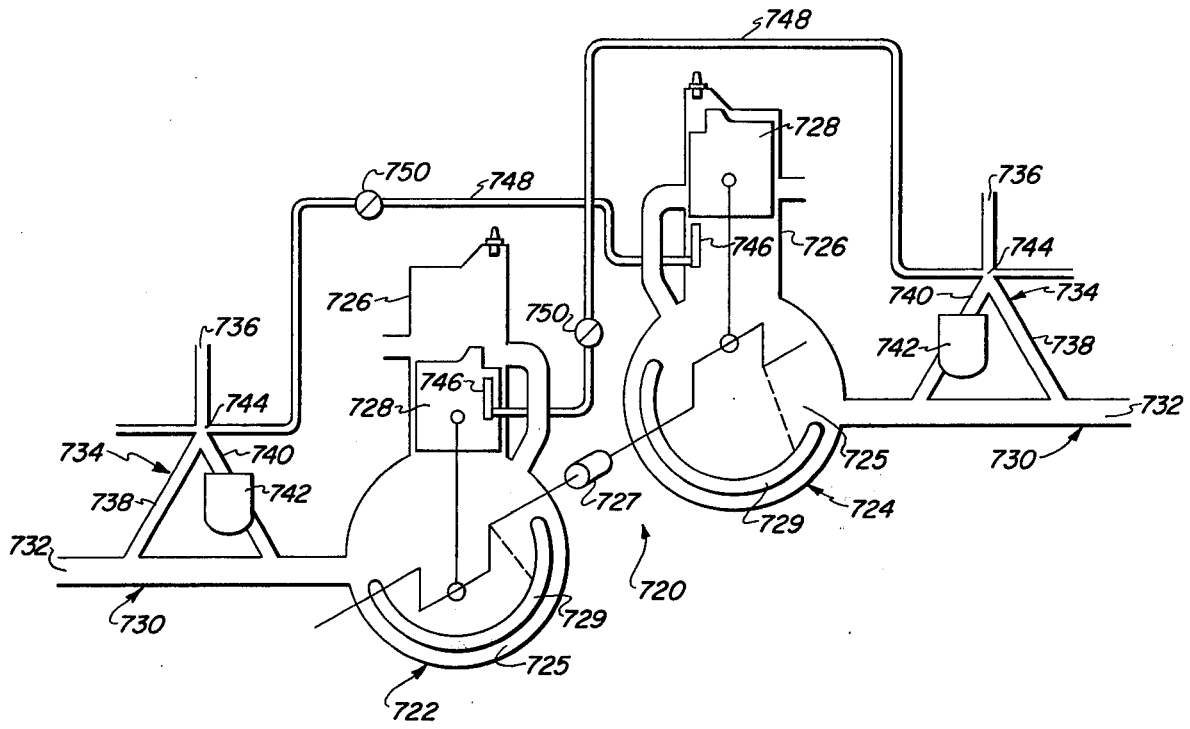
FIG. 12 is a diagrammatic illustration of a two-cycle, two-cylinder internal combustion engine employing an induction arrangement which demonstrates still another embodiment of the invention.
Figure 13:
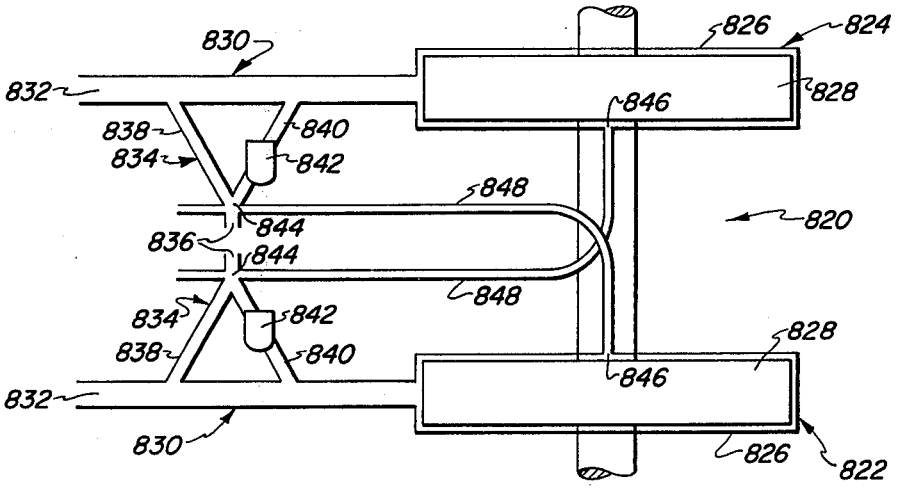
Figure 14:
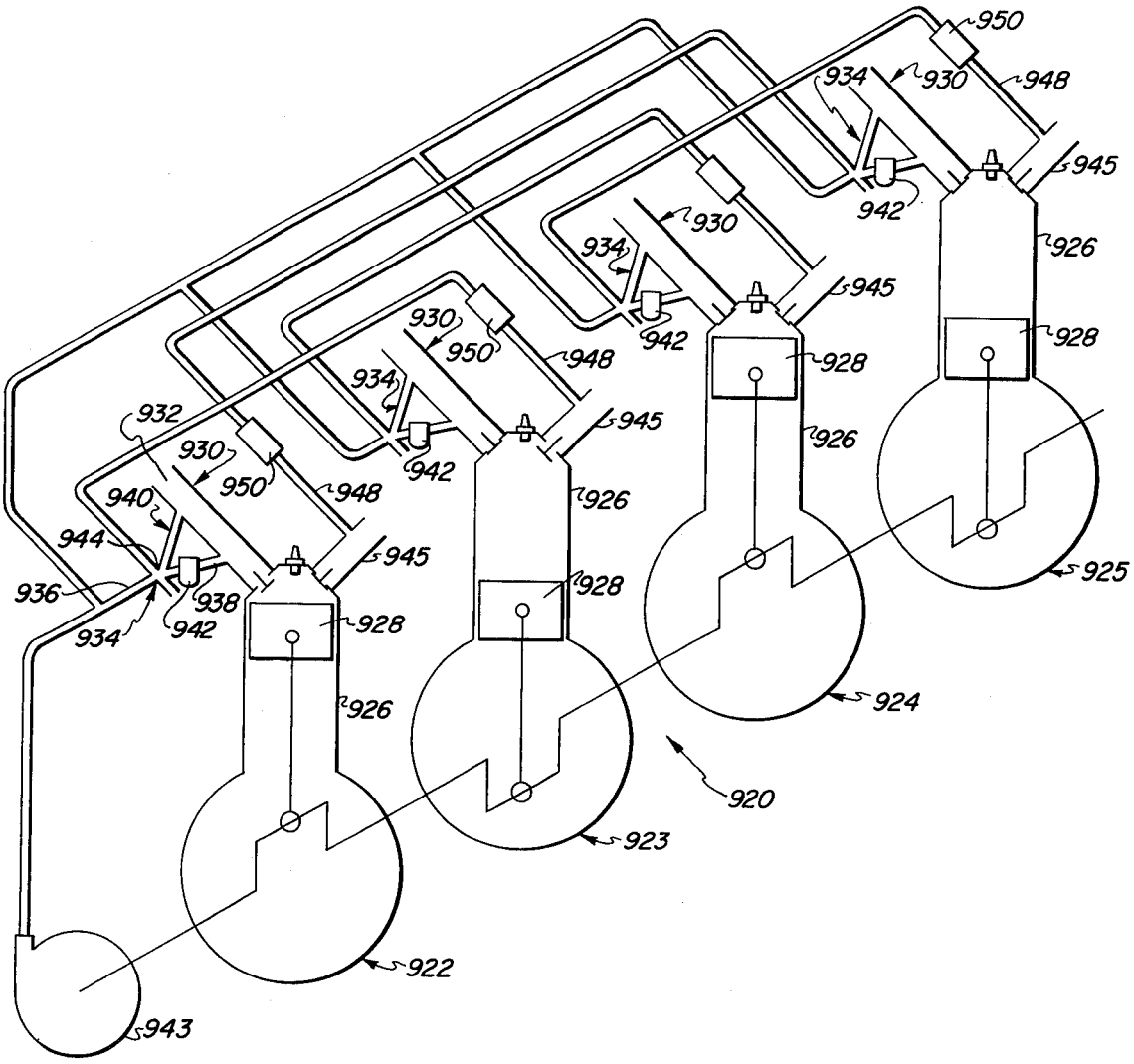

FIG. 13 is a diagrammatic illustration of a two-rotor rotary internal combustion engine employing an induction arrangement which demonstrates an embodiment of the invention similar to that of FIG. 12, but utilized in a rotary engine; and FIG. 14 is a diagrammatic illustration of a four-cycle, four-cylinder internal combustion engine employing an induction arrangement which demonstrates an embodiment of the invention similar to that of FIG. 12, but utilized in a four-cycle engine.

Figure 1:
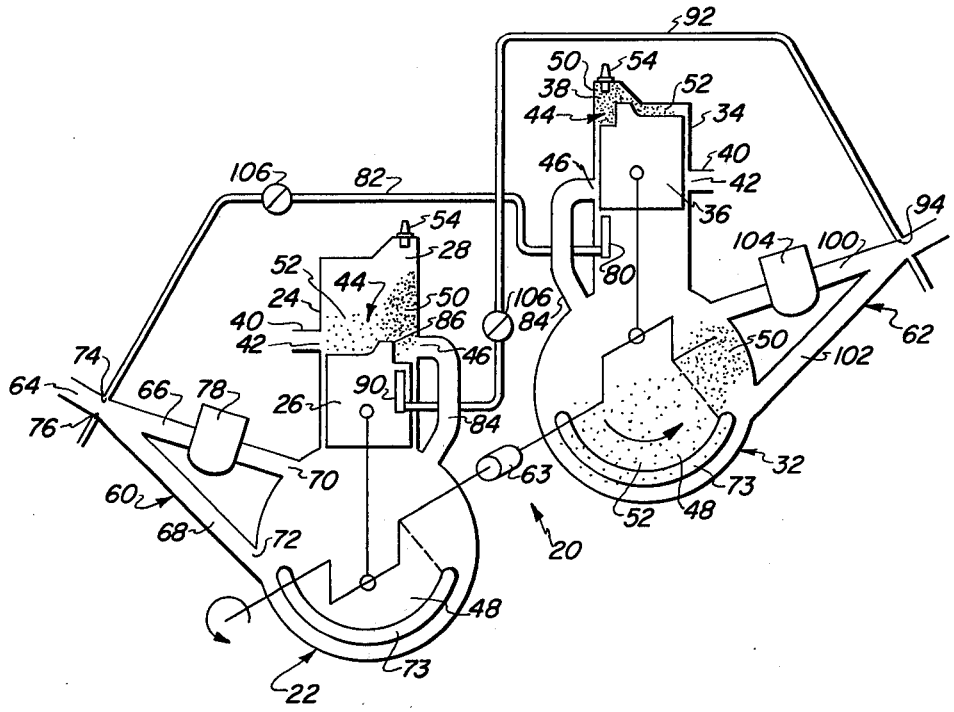
FIG. 1 is a diagrammatic illustration of a two-cycle, two-cylinder internal combustion engine employing an induction arrangement which demonstrates one embodiment of the invention.
Figure 2:
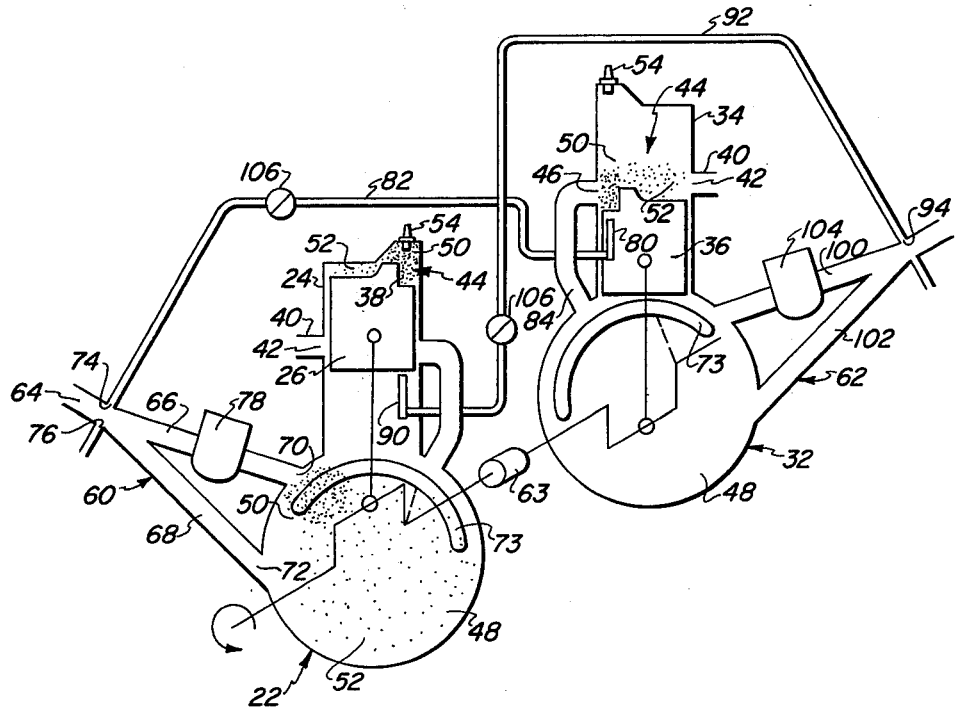
FIG. 2 is a diagrammatic illustration of the engine of FIG. 1, with the component parts in another operating position.
Figure 3:
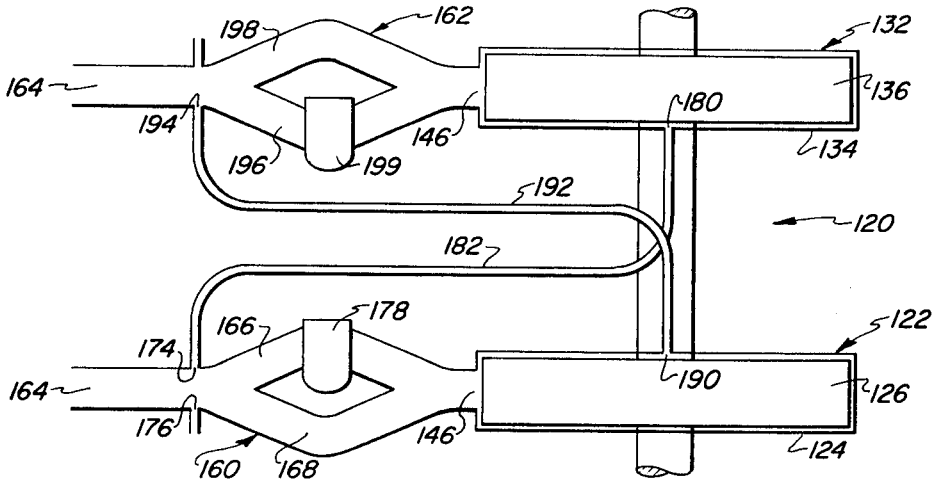
FIG. 3 is a diagrammatic illustration of a two-rotor rotary internal combustion engine employing an induction arrangement which demonstrates an embodiment of the invention similar to that of FIG. 1 and 2, but utilized in a rotary engine.

Referring now to the drawing, and especially to FIGS. 1 and 2 thereof, a two-cylinder, two-cycle internal combustion engine is illustrated diagrammatically at 20 and employs an induction arrangement constructed in accordance with the invention. Engine 20 has a first combustion section 22, which includes a cylinder 24 and a piston 26 establishing a combustion chamber 28, and a second combustion section 32, which includes a cylinder 34 and a piston 36 establishing a combustion chamber 38. Each combustion section has an exhaust arrangement 40 which includes an exhaust passage 42 communicating with a respective cylinder 24 and 34.

As is conventional in a two-cycle internal combustion engine, a mixture of fuel and air is introduced as a charge 44 into each combustion chamber 28 and 38 through an intake 46 which communicates with each respective cylinder 24 and 34. An induction arrangement delivers the appropriate fuel and air mixture for the charge to the crankcase 48 of each combustion section and the charge 44 is transferred to the combustion chamber, through the corresponding intake.

In order to reduce pollutants in the exhaust, the charge 44 delivered to each combustion chamber 28 and 38 is stratified; that is, charge 44 is provided with a first portion 50, which is a mixture of fuel and air, and a second portion 52, which is pure air. Portion 50 is a fuel-rich mixture containing fuel in excess of the stoichiometric ratio for fuel and air in a combustible mixture. The fuel-rich, fuel-air mixture of first portion 50 of charge 44 will be located within each combustion chamber in the zone contiguous with the spark plug 54, while second portion 52 will be located beyond first portion 50 in the direction away from spark plug 54. In this manner, ignition will occur in the fuel-rich zone. Combustion temperature is lowered by virtue of the high fuel-air ratio, and nitrous oxides are reduced. As the combustion process flows into the pure air portion 52, hydrocarbons and carbon monoxide are oxidized to essentially eliminate these pollutants from the exhaust.

Engine 20 has a system which provides the desired stratified charge 44. The system has induction means including a first intake manifold 60 communicating with the crankcase 48 of the first combustion section 22 and a second intake manifold 62 communicating with the crankcase 48 of the second combustion section 32. The crankcases 48 are sealed from one another by a crankshaft journal bearing 63 located in the wall between the crankcases of the first and second combustion sections 22 and 32. Intake manifold 60 is in the form of a wall-attachment monostable fluidic amplifier having an inlet 64, a first alternate outlet in the form of passage 66 and a second alternate outlet in the form of passage 68. First passage 66 communicates with crankcase 48 at outlet 70, while second passage 68 communicates with crankcase 48 at outlet 72. Valve means, such as a conventional rotary valve 73, is timed to close outlets 70 and 72 when the pressure within crankcase 48 is positive. A control signal port 74 is placed adjacent inlet 64 and a bias vent 76 is located opposite port 74. First passage 66 of the intake manifold 60 is the "preferred" leg of the fluidic amplifier; that is, air entering at the inlet 64 normally will flow into the crankcase through first outlet passage 66 and outlet 70. Means is provided for supplying fuel to the air which passes through passage 66 and is shown in the form of carburetor 78.

A bleed port 80 is located in the wall of cylinder 34 of the second combustion section 32 and is interconnected with control signal port 74 via conduit 82. As piston 26 travels from the bottom dead-center position, shown in FIG. 1, toward the top deadcenter position, shown in FIG. 2, a partial vacuum in crankcase 48 of the first combustion section 22 will cause air to flow through intake manifold 60 into the crankcase. At the same time, piston 36 travels from the top dead-center position, shown in FIG. 1, toward the bottom dead-center position, shown in FIG. 2, causing a rise in pressure in cylinder 34 beneath piston 36, and a concomitant rise in pressure at bleed port 80 and, consequently, at control signal port 74. Thus, a signal from cylinder 34 controls the flow of air in intake manifold 60 and causes the initial portion of charge 44 to flow through second passage 68, thereby providing pure air for second portion 52 of charge 44. When piston 36 reaches the position where bleed port 80 is closed, the flow of air from inlet 64 of intake manifold 60 is switched to the preferred leg, thus passing through first passage 66 and carburetor 78 to provide a fuel-rich, fuel-air mixture for first portion 50 of charge 44. Upon completion of the upward travel of piston 26 and the downward travel of piston 36, as seen in FIG. 2, crankcase 48 of the first combustion section 22 is charged with a charge 44 having a fuel-rich, fuel-air mixture in portion 50 and a pure air portion 52.

As piston 26 moves downwardly from the top dead-center position, shown in FIG. 2, toward the bottom dead-center position, shown in FIG. 1, the pressure in crankcase 48 of the first combustion section 22 increases until intake 46 in cylinder 24 is cleared by piston 26 and by-pass passage 84 communicates with combustion chamber 28. Charge 44 then passes into combustion chamber 28, with portion 52 of pure air preceeding the fuel-rich, fuel-air mixture of portion 50. The pure air portion 52 sweeps across the top of piston 26, purging the exhaust products from the combustion chamber 24 through exhaust passage 42. The fuel-rich, fuel-air mixture which follows, in portion 50, becomes located adjacent area 86 of the top of piston 26 and, upon upward movement of piston 26, is placed in a zone contiguous with spark plug 54. Charge 44 is thus stratified into portions 50 and 52. When the spark plug is fired, combustion will take place initially in portion 50 of the stratified charge in the combustion chamber and will propagate toward portion 52, thereby obtaining the desired reduction of combustion pollutants as described above. At the same time, efficiency of the engine is increased by virtue of the initial purging of the combustion chamber with pure air, rather than with a fuel-air mixture as in a two-cycle engine with a conventional induction arrangement. Since only pure air forces the burned gases through the exhaust port, rather than air mixed with fuel, fuel economy is increased by assuring that the incoming fuel charge is not swept through the exhaust port.

The operation of the second combustion section 32 is identical to that of first combustion section 22, with a bleed port 90 in cylinder 24 providing a control signal, via a conduit 92, to control signal port 94 in intake manifold 62 to cause switching between alternate souces of air provided by first and second passages 100 and 102 in intake manifold 62, one of the sources being a source of pure air, through passage 102, and the other source being a source of fuel-rich, fuel-air mixture through passage 100 and carburetor 104. Each conduit 82 and 92 is provided with a check valve 106 to preclude back flow into the respective crankcases during movement of each piston toward the top deadcenter position thereof. Thus, it will be seen that the cyclic pressure changes in one combustion section of the engine control switching of the source of intake air from one leg to the other leg of the intake manifold of the other combustion section.

Turning now to FIGS. 3 through 7, a two-rotor rotary internal combustion engine is illustrated diagrammatically at 120 and employs an induction arrangement constructed in accordance with the invention and similar to that described above, in connection with engine 20.

Engine 120 has a first combustion section 122 which includes a housing 124 and a rotating piston or rotor 126 establishing a combustion chamber 128, and a second combustion section 132 which includes a housing 134 and a rotating piston or rotor 136 establishing a combustion chamber 138. Engine 120 is of the "Wankel" type rotary engine having two rotors.

Each combustion section has an exhaust arrangement 140 which includes an exhaust passage 142 communicating with a respective housing 124 and 134. A charge 144 of fuel and air is introduced into each combustion chamber by rotation of a respective piston to bring the charge from an intake port 146 in each housing to the combustion chamber in that housing. An induction arrangement delivers the appropriate fuel and air mixture for the charge to the housing of each combustion section.

In order to reduce pollutants in the exhaust, as described above, charge 144 is stratified into a first portion 150, which is a fuel-rich mixture of fuel and air, and a second portion 152, which is pure air. As before, portion 150 is a fuel-rich mixture containing fuel in excess of the stoichiometric ratio. Portion 150 is to be located in the zone adjacent spark plug 154, while portion 152 is to be located beyond first portion 150 in the direction away from spark plug 154.

The system which provides the stratified charge 144 in engine 120 has induction means including a first intake manifold 160 communicating with the housing 124 of the first combustion section 122 and a second intake manifold 162 communicating with the housing 134 of the second combustion section 132. Each intake manifold is in the form of a wall-attachment monostable fluidic amplifier having an inlet 164, a first alternate outlet leg in the form of passage 166 and a second alternate outlet leg in the form of passage 168. First and second passages 166 and 168 communicate with the interior of housing 124 at intake port 146. A control signal port 174 is placed adjacent inlet 164 and a bias vent 176 is located opposite control signal port 174. As in the embodiment described in connection with FIGS. 1 and 2, a carburetor 178 is placed in the preferred leg of the fluidic amplifier.

A bleed port 180 is located in housing 134 of the second combustion section 132 and is interconneced with control signal port 174 via conduit 182. As rotor 126 rotates clockwise from the position illustrated in FIG. 4 toward the position illustrated in FIG. 5, the partial vacuum formed in housing 124, behind face 186 of rotor 126 will cause air to flow through intake manifold 160 into the housing 124. At the same time, rotor 136 rotates in a clockwise direction from the position illustrated in FIG. 4 toward the position shown in FIG. 5, causing a rise in pressure within the compression volume of housing 134 ahead of face 188 of rotor 136, and a concomitant rise in pressure at bleed port 180 and, consequently, at control signal port 174. Thus, a signal from the compression volume of housing 134 controls the flow of air in intake manifold 160 and causes the initial portion of charge 144 to flow thrugh second passage 168, thereby providing pure air for second portion 152 of charge 144. When rotor 136 reaches the position where bleed port 180 is covered by the rotor and thereby closed, the flow of air from inlet 164 of intake manifold 160 is switched to the preferred leg, thus passing through first passage 166 and carburetor 178 to provide a fuel-rich, fuel-air mixture for first portion 150 of charge 144. Charge 144 is thereby provided with a fuel-rich, fuel-air mixture in portion 150 and a pure air portion 152.

Figure 4:
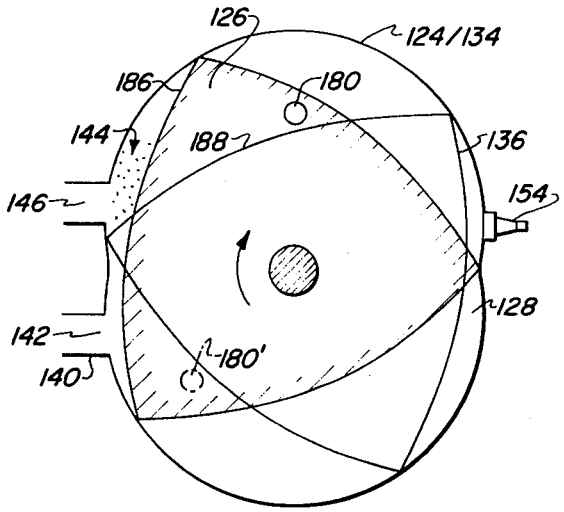
FIGS. 4 through 7 are diagrammatic illustrations of the engine of FIG. 3 with the rotors in different operating positions.
Figure 5:
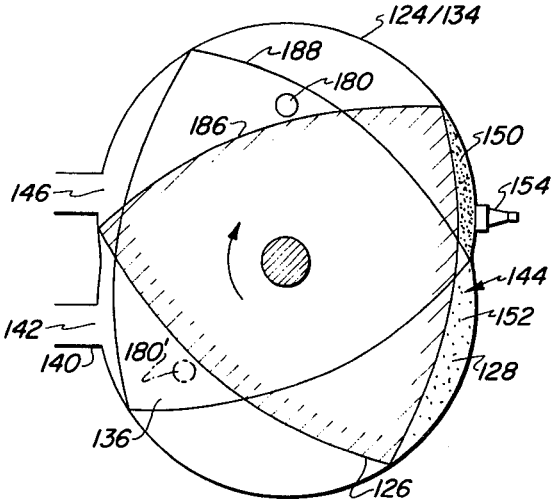

As rotor 126 rotates clockwise from the position shown in FIG. 4 toward that illustrated in FIG. 5, charge 144 is swept through housing 124 into combustion chamber 128, with portion 152 of pure air preceeding the fuel-rich, fuel-air mixture of portion 150. When the rotor 126 reaches the position illustrated in FIG. 5, the fuel-rich, fuel-air mixture is placed in a zone contiguous with spark plug 154 and charge 144 is stratified into portions 150 and 152. When the spark plug is fired, combustion will take place initially in portion 150 of the stratified charge in the combustion chamber and will propagate toward portion 152, thereby obtaining the desired reduction of combustion pollutants as described above.

Figure 6:
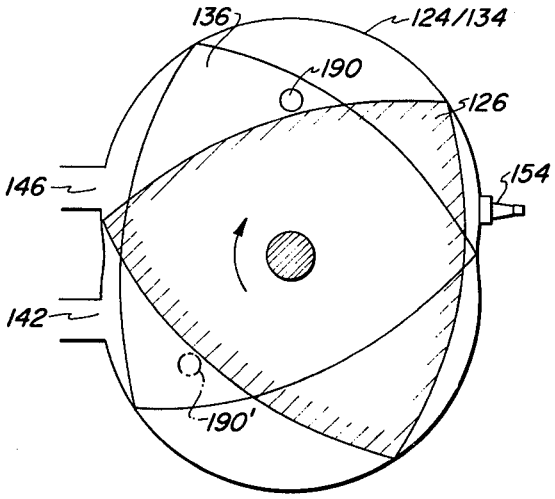
Figure 7:
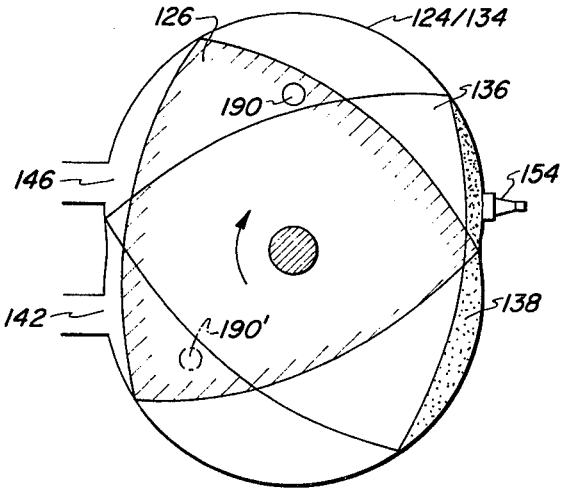

As illustrated in FIGS. 6 and 7, the operation of the second combustion section 132 is identical to that of first combustion section 122, with a bleed port 190 in housing 124 providing a control signal, via a conduit 192, to control signal port 194 in intake manifold 162 to cause switching between alternate sources of air provided by first and second passages 196 and 198 in intake manifold 162, one of the sources being a source of pure air, through passage 198, and the other source being a source of fuel-rich, fuel-air mixture through passage 196 and carburetor 199.

It is noted that by virtue of the location of each bleed port 180 and 190, relative to the respective rotor 126 and 136, the ratio of pure air to fuel-rich, fuel-air mixture in the stratified charge is fixed. In the illustrated embodiment, pure air is fed to the housing for the first eighty percent of intake, while fuel-rich, fuel-air mixture is fed during the last twenty percent of the intake, to produce a stratified charge. Changing the location of the bleed ports will effect a change in the ratio within the stratified charge. Thus, there is flexibility in that a design parameter may be changed with ease to obtain a desired effect. As an alternative to bleed ports 180 and 190, bleed ports can be placed in the housings so as to sense the pressure in the exhaust volume of the housings, as seen in phantom at 180' and 190', rather than in the compression volume, as shown in full lines at 180 and 190.

It has been found that in the use of fluidic amplifiers to switch a main flow of fluid in response to a control flow, the amount of the control flow required is about ten percent of the main flow. Bleeding such an amount of air from the engine compression volume or crankcase as described above will result in less power output for a given size engine. In order to improve engine performance, another embodiment of the invention, illustrated in FIG. 8, employs an arrangement in which the volume of control flow is reduced in relation to the volume of the main flow.

Figure 8:
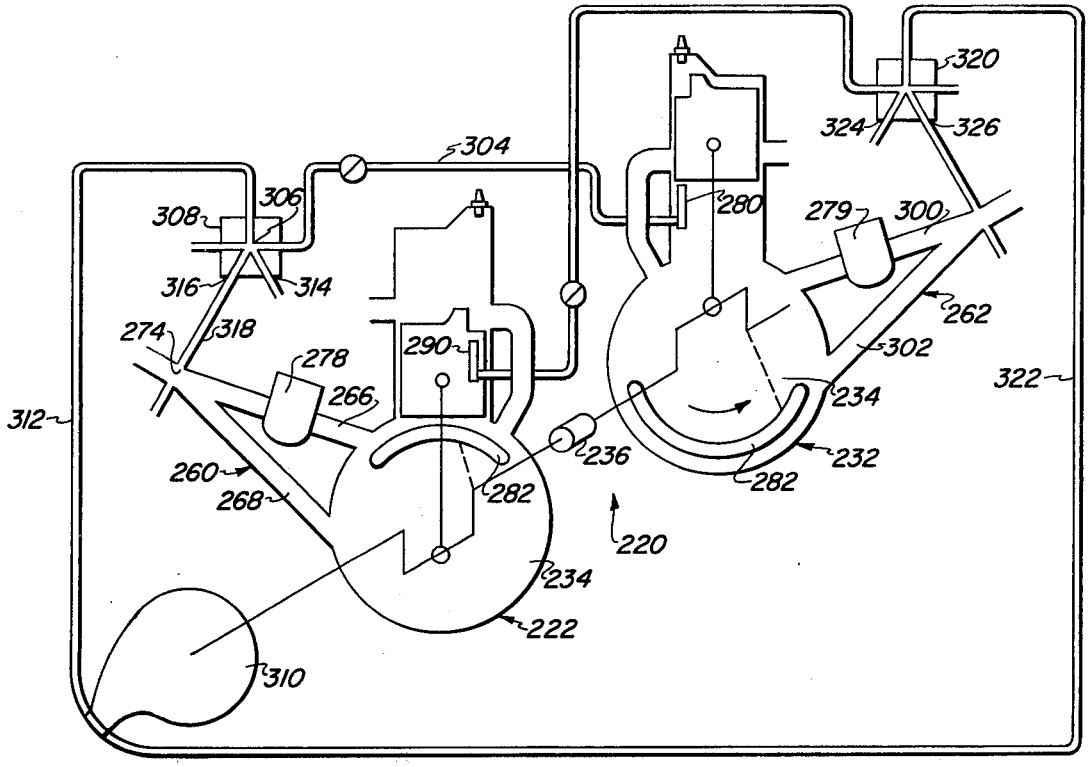
FIG. 8 is a diagrammatic illustration of a two-cycle, two-cylinder internal combustion engine employing an induction arrangement which demonstrates another embodiment of the invention.

Referring now to FIG. 8, a two-cylinder, two-cycle internal combustion engine is illustrated diagrammatically at 220 and employs an alternate induction arrangement constructed in accordance with the invention. Engine 220 is very similar to engine 20 in that the two combustion sections 222 and 232 each have a crankcase 234, the crankcases 234 being sealed from one another by a journal bearing 236 located in the wall between the crankcases 234, and an intake manifold 260 and 262, respectively, in the form of a wall-attachment monostable fluidic amplifier having a carburetor 278, or 279, in the preferred leg of the amplifier. A bleed port 280 in the cylinder of the second combustion section 232 supplies the control signal for switching the main intake flow between the first leg 266 and the second leg 268 of the intake manifold 260 of the first combustion section 222, while a bleed port 290 in the cylinder of the first combustion section 222 supplies the control signal for switching the main intake flow between the first leg 300 and the second leg 302 of the intake manifold 262 of the second combustion section 232. Valve means, such as a conventional rotary valve 282, is timed to close communication between the legs of each intake manifold and the respective crankcase when the pressure within the crankcase is positive.

However, in order to reduce the amount of flow from bleed port 280, while still attaining switching of the main intake flow in intake manifold 260, a conduit 304 connects bleed port 280 with the control port 306 of a secondary fluidic amplifier 308. A low pressure blower 310 is driven by engine 220 and serves as a source of air under pressure to supply a main control flow of air, via conduit 312, to the input of amplifier 308. Amplifier 308 has alternate output legs 314 and 316, leg 314 being the preferred leg and leg 316 being connected, via conduit 318 to the control signal port 274 of the main amplifier formed by the intake manifold 260. In this manner, a rise in pressure at bleed port 280 will switch the main control flow of blower air, which enters the input of amplifier 308, from preferred leg 314 to leg 316 and hence to control signal port 274, via conduit 318. The main flow in intake manifold 260 will thus be switched from preferred first leg 266 to the second leg 268 of intake manifold 260, and pure air will be supplied to the first combustion section 222. When bleed port 280 is closed, the main control flow of air in secondary amplifier 308 will revert to preferred output leg 314, with the result that the main intake flow in the intake manifold 260 will be switched to preferred leg 266 to supply a fuel-rich, fuel-air mixture to the first combustion section 222. Since the amount of the main control flow supplied by blower 310 to control signal port 274 is approximately ten percent of the main intake flow, and since the control flow from the bleed port 280 to control port 306 of secondary amplifier 308 need be only about ten percent of the main control flow in amplifier 308, it follows that the amount of flow from the bleed port 280 is reduced to about one percent of the main intake flow in intake manifold 260.

In a like manner, the amount of flow from bleed port 290 is reduced to about one percent of the main intake flow in intake manifold 262 of the second combustion section 232 through the employment of a secondary fluidic amplifier 320 which enables the flow from bleed port 290 to control the flow of input low pressure blower air from conduit 322 to either of the first and second output legs 324 and 326 of amplifier 320.

Figure 9:
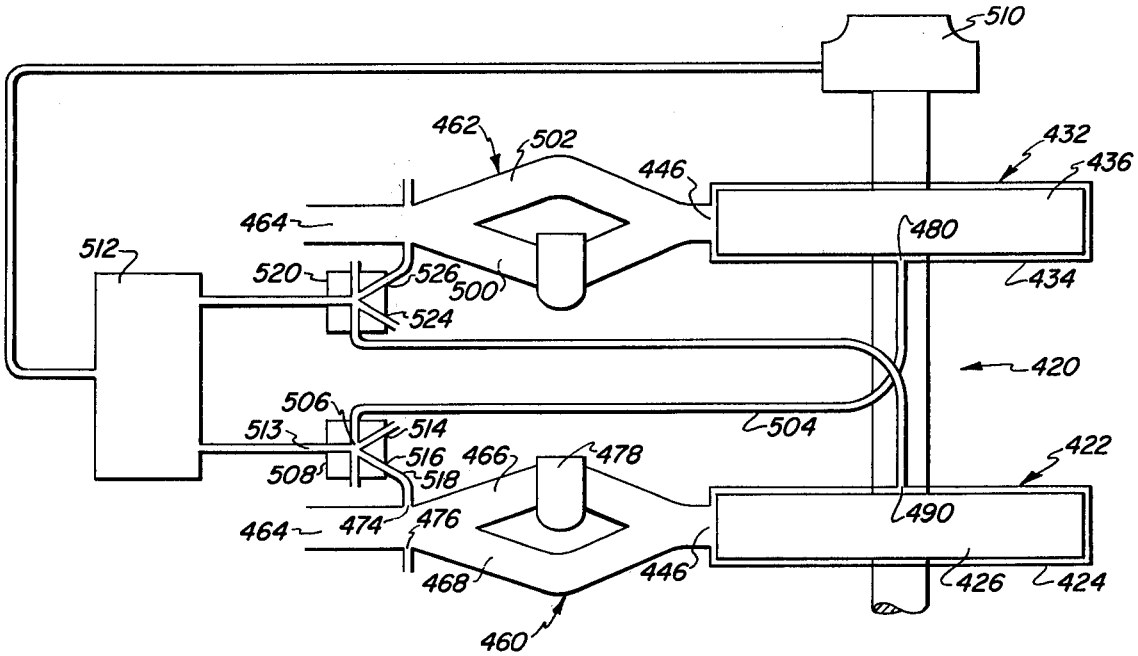
FIG. 9 is a diagrammatic illustration of a two-rotor rotary internal combustion engine employing an induction arrangement which demonstrates an embodiment of the invention similar to that of FIG. 8, but utilized in a rotary engine.

Turning now to FIG. 9, a two-rotor rotary internal combustion engine very similar to engine 120 is illustrated diagrammatically at 420 and employs an induction arrangement constructed in accordance with the invention, and similar to the induction arrangement described in connection with engine 220. As in engine 120, the present engine 420 has a first combustion section 422 which includes a housing 424 and a rotating piston of rotor 426, and a second combustion 432 which includes a housing 434 and a rotating piston or rotor 436.

The system which provides a stratified charge in engine 420 has induction means including a first intake manifold 460 communicatingwith the housing 424 of the first combustion section 422 and a second intake manifold 462 communicating with the housing 434 of the second combustion section 432. Each intake manifold is in the form of a wall-attachment monostable fluidic amplifier having an inlet 464. Intake manifold 460 has a first alternate outlet leg in the form of passage 466 and a second alternate outlet leg in the form of passage 468.

First and second passages 466 and 468 communicate with the interior of housing 424 at intake port 446. A control signal port 474 is placed adjacent inlet 464 and a bias vent 476 is located opposite control signal port 474. A carburetor 478 is placed in the preferred leg of the fluidic amplifier established in intake manifold 460. A bleed port 480 in the housing of the second combustion section 432 supplies the control signal for switching the main intake flow between the first passage 466 and the second passage 468 of the intake manifold 460 of the first combustion section 422, while a bleed port 490 in the housing of the first combustion section 422 supplies the control signal for switching the main intake flow between the first passage 500 and the second passage 502 of the intake manifold 462 of the second combustion section 432.

In order to reduce the amount of flow from bleed port 480, while still attaining switching of the main intake flow in intake manifold 460, a conduit 504 connects bleed port 480 with the control port 506 of a secondary fluidic amplifier 508. A low pressure blower 510 is driven by engine 420 and supplies air under pressure to a plenum chamber 512, which is connected to the input leg 513 of amplifier 508. Amplifier 508 has alternate output legs 514 and 516, leg 514 being the preferred leg and leg 516 being connected, via conduit 518 to the control signal port 474 of the main amplifier formed by the intake manifold 460. In this manner, a rise in pressure at bleed port 480 will switch the main control flow of air supplied from the plenum chamber 512 so that the main control flow entering input leg 513 of amplifier 508 will be switched from preferred leg 514 to leg 516 and hence to control signal port 474, via conduit 518. The main flow in intake manifold 460 will thus be switched from preferred first passage 466 to the second passage 468 of intake manifold 460, and pure air will be supplied to the first combustion section 422. When bleed port 480 is closed by rotor 436, as explained in connection with the description of engine 120, the main control flow of air in secondary amplifier 508 will revert to preferred output leg 514, with the result that the main intake flow in intake manifold 460 will be switched to preferred passage 466 to supply a fuel-rich, fuel-air mixture to the first combustion section 422. Here, as in engine 220, the amount of flow from the bleed port 480 is reduced to about one percent of the main intake flow in intake manifold 460.

In a like manner, the amount of flow from bleed port 490 is reduced to about one percent of the main intake flow in intake manifold 462 of the second combustion section 432 through the employment of secondary fluidic amplifier 520 which enables the flow from bleed port 490 to control the flow of input blower air, supplied from plenum chamber 512, to either of the first and second output legs 524 and 526 of the amplifier 520.

A similar induction arrangement is illustrated in connection with a four-cycle internal combustion engine in FIGS. 10 and 11, wherein a four-cycle, four-cylinder internal combustion engine is shown diagrammatically at 620. Engine 620 has four combustion sections 622, 624, 626 and 628, each of which has a piston 630 operating in a cylinder 632 and establishing a combustion chamber 634. Each combustion section has an exhaust outlet arrangement which includes an exhaust valve 636 and an exhaust manifold 638.

As in conventional four-cycle internal combustion engines, intake is accomplished through an intake valve 640 in each cylinder 632. An induction arrangement delivers the proper fuel and air mixture for appropriate charging of each cylinder through a respective intake valve. As explained above in connection with other embodiments of the invention, pollutants in the exhaust are reduced by delivering a stratified charge 642 to each combustion chamber 634, the charge being stratified into a first portion 644, which is a mixture of fuel and air, and a second portion 646, which is pure air. Portion 644 is a fuel-rich mixture containing fuel in excess of the stoichiometric ratio for fuel and air in a combustible mixture.

The system which provides the desired stratified charge 642 has induction means including an intake manifold 650 for each combustion section. As before, each intake manifold 650 is in the form of a wall-attachment monostable fluidic amplifier having an inlet 652, a first alternate leg in the form of passage 654 and a second alternate leg in the form of passage 656, both passages communicating with a common outlet passage 658 leading to intake valve 640. In this instance, the preferred leg of the amplifier of manifold 650 is passage 654 while a carburetor 660 is placed in the leg provided by the other passage 656. A control signal port 662 is provided for enabling switching of the flow from inlet 652 to either one of the passages 654 or 656.

As described previously in connection with other embodiments of the invention, the appropriate air flow for switching purposes is supplied to control signal port 662 of each intake manifold from an engine driven blower 664 via a secondary fluidic amplifier 666 having an inlet leg 668 connected to the blower through a conduit 670. Secondary amplifier 666 has a preferred output leg 672, which is open, an alternate output leg 674 connected to control signal port 662, and a control port 676.

Figures 10, 11:
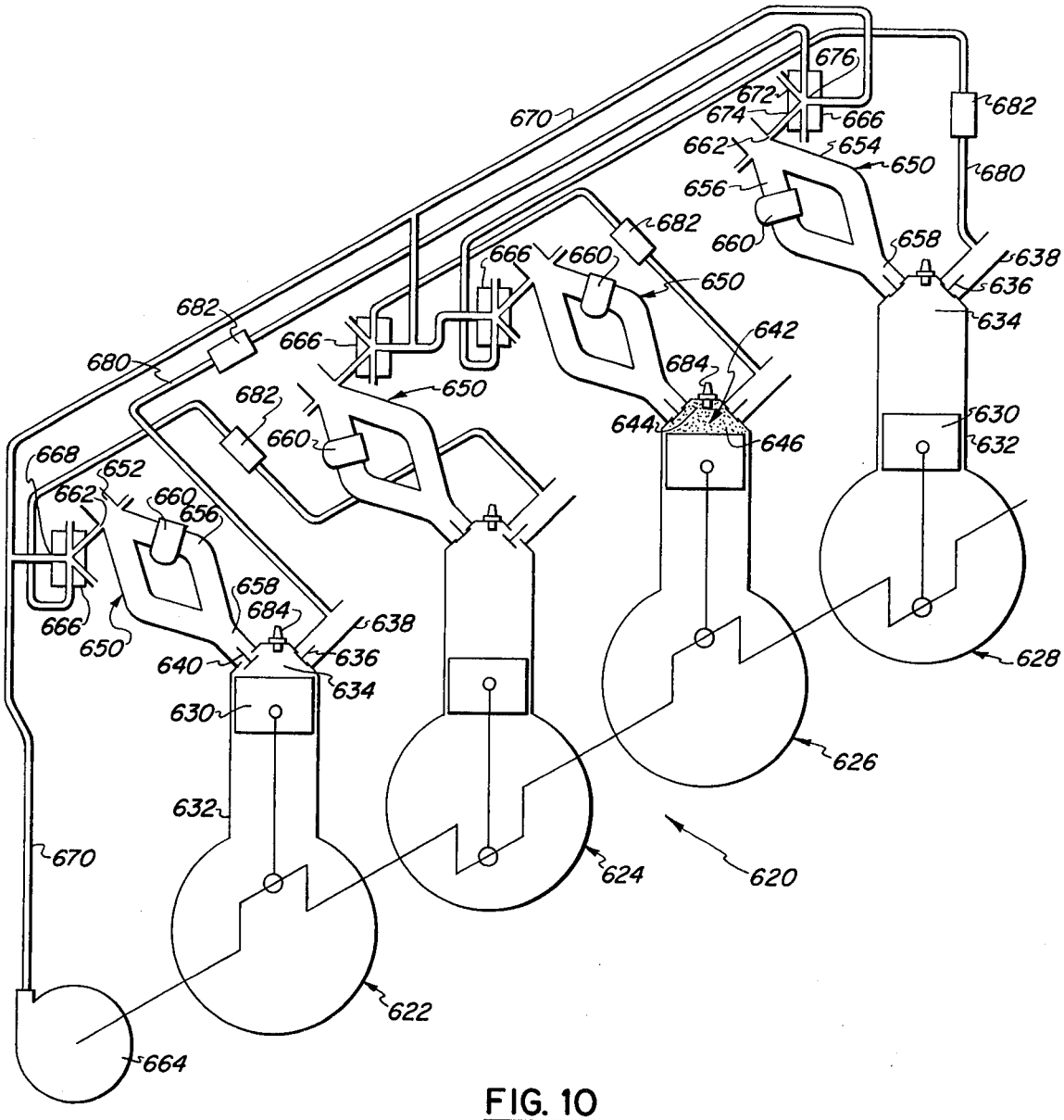
FIG. 10 is a diagrammatic illustration of a four-cycle four-cylinder internal combustion engine employing an induction arrangement which demonstrates an embodiment of the invention similar to that of FIG. 8, but utilized in a four-cycle engine.
FIG. 11 is a table illustrating a scheme of operation for the engine of FIG. 10.

The control port 676 of one combustion section is connected to the exhaust manifold 638 of another combustion section via a control circuit 680 through a capacitive reservoir 682 in accordance with the scheme illustrated diagrammatically in FIG. 10, for operation as illustrated in the table of FIG. 11. Thus, as intake starts in combustion section 622, exhaust starts in combustion section 624. Initially, exhaust pressure in the exhaust manifold of combustion section 624 is low enough so that blower air to the secondary amplifier of combustion section 622 exhausts through preferred output leg 672 and no switching signal is placed at control signal p1ort 662. Thus, pure air will be supplied at the intake valve 640 of combustion section 622, via the preferred leg provided by passage 654 of the intake manifold. As exhaust continues in combustion section 624, exhaust pressure builds up in the exhaust manifold of that combustion section. The pressure at control port 676 then becomes great enough to switch the flow of blower air to output leg 674 of secondary amplifier 666 of combustion section 622, thereby causing the flow in the intake manifold of that combustion section to switch from passage 654 to passage 656. For the remainder of the intake stroke, a fuel-rich, fuel-air mixture is provided at the intake valve of combustion section 622 by the carburetor 660. The charge 642 thus provided to the cylinder 632 of combustion section 622 is stratified into the fuel-rich, fuel-air mixture of portion 644, which is located in the zone contiguous with spark plug 684, and the pure air portion 646 located beyond portion 644 in the direction away from the spark plug. By reference to the table in FIG. 11, it will be seen that the intake stroke in each combustion section is matched by an exhaust stroke in another combustion section; hence, a control signal is available to switch the flow in each intake manifold, during intake, so as to provide a stratified charge in every cylinder.

It is a characteristic of fluidic amplifiers of the type illustrated herein that switching time is dependent upon the mass of the fluid flowing through the amplifier. Generally the switching time is shorter for a smaller mass flow. In order to shorten the response time of the system which provides the stratified charge, the following embodiments of the invention, illustrated diagrammatically in FIGS. 12 through 14, employ fluidic amplifiers in such a way that mass flow through the amplifiers is reduced, with a concomitant reduction in switching time.

Referring first to FIG. 12, a two-cylinder, two-cycle internal combustion engine is illustrated diagrammatically at 720 and employs an alternate induction arrangement constructed in accordance with the invention. Engine 720 is similar to engine 20 in that engine 720 has two combustion sections 722 and 724, each section having a cylinder 726 and a piston 728. Crankcases 725 are separated and sealed from one another by a wall in which there is located a journal bearing 727 which completes the seal between the crankcases.

The induction arrangement includes a primary intake manifold 730 having a primary passage 732 communicating with the crankcase of each combustion section 722 and 724. Valve means, such as a conventional rotary valve 729, is timed to close communication between each primary passage 732 and the respective crankcase when the pressure within the crankcase is positive. A secondary intake manifold 734 communicates with each primary passage 732 and is constructed in the form of monostable fluidic amplifier having an inlet passage 736 and alternate outlet passages 738 and 740. Outlet passage 740 is the preferred leg of the amplifier and a carburetor 742 is placed in outlet passage 740. A control signal port 744 in the amplifier of one combustion section is connected to a bleed port 746 in the other combustion section, via a connecting conduit 748 and a check valve 750.

Operation of engine 720 is similar to that of engine 20 in that the location of pistons 728 relative to bleed ports 746 controls the switching of the intake flow between outlet passages 738 and 740 of the fluidic amplifiers provided by secondary intake manifolds 734. Thus, each crankcase is charged initially with pure air, through passage 732 of primary intake manifold 730 and outlet passage 738, which constitutes the non-preferred leg of the fluidic amplifier of secondary intake manifold 734, and is then charged with a fuel-rich, fuel-air mixture which enters passage 732 through outlet passage 740 of the secondary intake manifold. The remainder of the cycle of operation is as described in connection with engine 20. Because the mass flow in the fluidic amplifiers provided by the secondary intake manifolds 734 is less than the mass flow in the fluidic amplifiers employed in the embodiment illustrated in connection with engine 20, switching time is reduced. Where mass flow in the secondary intake manifolds is reduced to about one-tenth the flow in the primary manifold, the result is a reduction in switching time to about one-tenth of the time necessary in the arrangement illustrated in connection with engine 20.

Turning next to FIG. 13, a two-rotor rotary internal combustion engine is illustrated diagrammatically at 820 and employs an alternate induction arrangement constructed in accordance with the invention. Engine 820 is similar to engine 120 in that engine 820 has two combustion sections 822 and 824, each section having a housing 826 and a rotor 828.

The induction arrangement includes a primary intake manifold 830 having a primary passage 832 communicating with the housing 826 of each combustion section 822 and 824. A secondary intake manifold 834 communicates with each primary passage 832 and is constructed in the form of a monostable fluidic amplifier having an inlet passage 836 and alternate outlet passages 838 and 840. A carburetor 842 is placed in outlet passage 840, which is the preferred leg of the amplifier. A control signal port 844 in the amplifier of one combustion section is connected to a bleed port 846 in the other combustion section, via a connecting conduit 848.

Operation of engine 820 is similar to that of engine 120 in that the location of rotors 828 relative to bleed ports 846 controls the switching of the intake flow between outlet passages 838 and 840 of the fluidic amplifiers provided by secondary intake manifolds 834. Thus, each housing is charged initially with pure air, through passages 832 of primary intake manifold 830 and outlet passage 838, which constitutes the non-preferred leg of the fluidic amplifier of secondary intake manifold 834, and is then charged with a fuel-rich, fuel-air mixture which enters passage 832 through outlet passage 840 of the secondary intake manifold. The remainder of the cycle of operation is as described in connection with engine 120. Because the mass flow in the fluidic amplifiers provided by the secondary intake manifolds 834 is less than the mass flow in the fluidic amplifiers employed in the embodiment illustrated in connection with engine 120, switching time is reduced.

Referring now to FIG. 14, a four-cylinder, four-cycle internal combustion engine is illustrated diagrammatically at 920 and employs an alternate induction arrangement constructed in accordance with the invention. Engine 920 is similar to engine 620 in that engine 920 has four combustion sections 922, 923, 924 and 925, each section having a cylinder 926 and a piston 928.

The induction arrangement includes a primary intake manifold 930 having a primary passage 932 communicating with the cylinder of each combustion section 922, 923, 924 and 925. A secondary intake manifold 934 communicates with each primary passage 932 and is constructed in the form of a monostable fluidic amplifier having an inlet passage 936 and alternate outlet passages 938 and 940. Outlet passage 940 is the preferred leg of the amplifier. A carburetor 942 is placed in outlet passage 938, which is the non-preferred leg of the amplifier. A blower 943 supplies air under pressure to the inlet passage 936 of the amplifier. A control signal port 944 in the amplifier of one combustion section is connected to the exhaust manifold 945 of another combustion section via a control conduit 948 through a capacitive reservoir 950 in accordance with the scheme described in connection with the embodiment illustrated in FIGS. 10 and 11.

Operation of engine 920 is similar to that of engine 620 in that the exhaust manifold pressure in a first combustion section provides the signal for controlling the switching of the intake flow in a second combustion section between outlet passages 938 and 940 of the fluidic amplifier provided by the secondary intake manifold 934 of that second combustion section. Thus, each cylinder is charged initially with pure air, through passage 932 of primary intake manifold 930 and outlet passage 940, which constitutes the preferred leg of the fluidic amplifier of secondary intake manifold 934, and is then charged with a fuel-rich, fuel-air mixture which enters passage 932 through outlet passage 938 of the secondary intake manifold. The remainder of the cycle of operation is as described in connection with engine 620. Because the mass flow in the fluidic amplifiers provided by the secondary intake manifolds 934 is less than the mass flow in the fluidic amplifiers employed in the embodiment illustrated in connection with engine 620, switching time is reduced.

It is to be understood that the above detailed description of embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. In an internal combustion engine having at least first and second combustion sections, each combustion section including an induction arrangement, an exhaust arrangement and a combustion chamber, a system for providing a stratified charge of air and a fuel-rich fuel-air mixture to each combustion chamber, said system comprising:

an intake for each combustion chamber;

induction means associated with each intake, each induction means providing alternate sources of air at the intake, said alternate sources including a first intake air passage and a second intake air passage, each communicating with the intake;

means for supplying fuel to establish a fuel-rich fuel-air mixture in one of said first and second intake air passages of each induction means; and fluidic means for switching the source of intake air from the first intake air passage to the second intake air passage during induction of a charge of fuel and air in one of said combustion sections in response to a cyclic pressure change in the other combustion section such that the charge passing into the intake will be stratified into portions of air and a fuel-rich fuel-air mixture.

2. The invention of claim 1 wherein the fluidic means includes:

a primary monostable fluidic amplifier in each induction means, each primary amplifier having a control signal port;

a bleed port in each combustion section; and means interconnecting the control signal port of an amplifier in one combustion section with a bleed port in another combustion section.

3. The invention of claim 2 wherein each primary amplifier has a preferred leg and a non-preferred leg, said legs of the amplifier coinciding, respectively, with the first and second air passages.

4. The invention of claim 3 wherein said means for supplying fuel comprises a carburetor in one of said legs of the primary amplifier.

5. The invention of claim 2 wherein the fluidic means further includes:

a source of air under pressure;

a secondary fluidic amplifier for each combustion section, each secondary amplifier having an input, alternate outputs and a control signal port;

means interconnecting the input of the secondary amplifier with the source of air under pressure;

means interconnecting one output of the secondary amplifier with the control signal port of the primary amplifier; and means interconnecting the control signal port of the secondary amplifier of one combustion section with the bleed port in another combustion section.

6. The invention of claim 5 wherein each primary amplifier has a preferred leg and a non-preferred leg, said legs of the amplifier coinciding, respectively, with the first and second air passages.

7. The invention of claim 6 wherein said means for supplying fuel comprises a carburetor in one of said legs of the primary amplifier.

8. The invention of claim 2 wherein the induction means has a primary intake manifold including a primary passage in each combustion section, and a secondary intake manifold including an intake leg and alternate outlet legs, said legs establishing said primary monostable fluidic amplifier with said outlet legs coinciding with the first and second air passages.

9. The invention of claim 8 wherein at least one of the alternate outlet legs of each secondary intake manifold communicates with the primary intake manifold, and said means for supplying fuel is located in said one of the alternate outlet legs.

10. The invention of claim 9 wherein said means for supplying fuel comprises a carburetor in said one of the alternate outlet legs.

11. The invention of claim 2 wherein the engine is a two-cycle internal combustion engine having a piston, a cylinder including a wall, and a crankcase in each combustion section, and the bleed port in located in position to detect change in pressure in the crankcase of a respective combustion section resulting from movement of the respective piston in one direction and to be closed by continued movement of the piston in that direction.

12. The invention of claim 11 wherein the position of the bleed port is such that said change in pressure in an increase in pressure.

13. The invention of claim 11 wherein the bleed port is located in the cylinder wall of the respective combustion section adjacent the crankcase.

14. The invention of claim 2 wherein the engine is a rotary internal combustion engine having a rotor and a housing including a wall, a compression volume and an exhaust volume, and the bleed port is located in position to detect a change in pressure in the housing of a respective combustion section resulting from movement of the respective rotor in one direction and to be closed by continued movement of the rotor in that direction.

15. The invention of claim 14 wherein the position of the bleed port is such that said change in pressure is an increase in pressure.

16. The invention of claim 14 wherein the bleed port is located in the housing wall of the respective combustion section at the compression volume of the housing.

17. The invention of claim 14 wherein the bleed port is located in the housing wall of the respective combustion section at the exhaust volume of the housing.

18. The invention of claim 2 wherein the engine is a fourcycle internal combustion engine having a piston, a cylinder, and an exhaust outlet in each combustion section and the bleed port is located in position to detect a change in pressure in the exhaust outlet of a respective combustion section resulting from the passing of exhaust from the cylinder through the exhaust from the cylinder through the exhaust outlet.

19. The invention of claim 18 wherein the bleed port is located in the exhaust outlet of the respective combustion section.

20. A method of providing a stratified charge of air and a fuel-rich fuel-air mixture to each combustion chamber of an internal combustion engine having at least first and second combustion sections, each combustion section including a combustion chamber having an intake and an exhaust, an induction arrangement communicating with the intake and an exhaust arrangement communicating with the exhaust, said method comprising the steps of:

providing alternate sources of air at the intake of each combustion chamber, said alternate sources including a first source of intake air and a second source of intake air;

supplying fuel to establish a fuel-rich, fuel-air mixture in one of said sources of intake air for each intake; and switching the source of intake air from the first intake air source to the second intake air source during induction of a charge of fuel and air in one of said combustion sections in response to a cyclic pressure change in the other combustion section such that the charge passing into the intake will be stratified into portions of air and a fuel-rich, fuel-air mixture.

21. The invention of claim 20 including the step of supplying additional air under pressure to said in the switching of the source of intake air.

* * * * *